US006012668A

United States Patent [19]

Zurfluh et al.

[11] Patent Number: 6,012,668

[45] Date of Patent: Jan. 11, 2000

[54] METHOD FOR THE CONTROLLED WINDING OR UNWINDING OF AN ELONGATED OBJECT ON OR FROM A REEL BODY

[76] Inventors: Louis Zurfluh, Grossriedstrasse 6, CH-6462 Seedorf; Robert Hedinger, In der Matte 9, CH-6460 Altdorf, both of Switzerland

[21] Appl. No.: 09/059,445

[22] Filed: Apr. 14, 1998

[51] Int. Cl.[7] ..... B65H 27/00; B65H 19/00

[52] U.S. Cl. ..... 242/397.3; 242/399.1; 242/413.2; 242/473.5; 242/474; 242/533.3; 242/559.1

[58] Field of Search ..... 242/413.2, 580, 242/399.1, 399.2, 533.2, 533.3, 559.1, 474, 473.5, 397.3

[56] References Cited

U.S. PATENT DOCUMENTS

| | | | |
|---|---|---|---|
| 3,061,225 | 10/1962 | Huck | 242/413.2 |
| 3,286,944 | 11/1966 | Kusel . | |
| 3,490,712 | 1/1970 | Mukai et al. | 242/413.2 |
| 3,498,560 | 3/1970 | Roller | 242/413.2 |
| 3,567,153 | 3/1971 | Becker et al. | 242/413.2 |
| 3,877,657 | 4/1975 | Zebley | 242/413.2 |
| 4,162,025 | 7/1979 | Achelpohl et al. . | |
| 4,893,762 | 1/1990 | Kuhn . | |

FOREIGN PATENT DOCUMENTS

| | | | |
|---|---|---|---|
| 2480725 | 10/1981 | France | 242/580 |
| 0128155 | 7/1985 | Japan | 242/580 |

*Primary Examiner*—John M. Jillions
*Assistant Examiner*—William A. Rivera
*Attorney, Agent, or Firm*—Wenderoth, Lind & Ponack, L.L.P.

[57] ABSTRACT

In a method for controlled winding of an elongated object, at least one elongated object (11) is guided by a guide head (35) to a reel body (15, 16), which is mounted to rotate and is rotated by a drive member (20). A program controlled adjustment of the speed variation as well as for the torque of the driver member (20) occurs, and depends on the measurable winding diameter (15') for a winding operation of the reel body (15, 16). By means of a regulator (50), the actual value of a tensile force on the elongated object (11) is measured by the torque on the drive member (20), and is compared with an adjustable reference value. In the case of a divergence, an actual value (57) is returned to the reference value. The reel body (15, 16) in this case rests on at least two driven drive shafts (22, 24). In addition, a lifting device for receiving the reel body is provided.

14 Claims, 5 Drawing Sheets

METHOD FOR THE CONTROLLED WINDING OR UNWINDING OF AN ELONGATED OBJECT ON OR FROM A REEL BODY

BACKGROUND OF THE INVENTION (1) Field of the Invention

The invention relates to a method and apparatus for controlling, winding or unwinding of an elongated object on or from a reel body, in which the at least one elongated object is guided by a guide head onto the reel body. The reel body is mounted to rotate, and is rotated by a drive member.

(2) State of the Prior Art

In a previous apparatus, a reel body defines a central bore and is held on both sides respectively by one journal engaging this bore. The journal, and consequently the reel body are then rotated by a motor for winding. In this case, a non-slip transmission of rotary movement from the motor to the reel body is not guaranteed. In particular, at the time of starting-up, sliding friction frequently occurs between the journal and the reel body due to the moment of inertia of the reel body. Consistent winding, in which windings are applied without a spacing between them on the reel body, cannot be achieved with this apparatus.

SUMMARY OF THE INVENTION

In comparison, an object of the present invention consists of providing a method and an apparatus of the type previously mentioned which precisely winds or unwinds and facilitates a constant tensile force on an elongated object, for example a wire. This controlled winding or unwinding should be carried out by an apparatus which has a simple construction and in addition allows for problem-free operation. Furthermore, in this apparatus, a reel body having an outer diameter up to one meter or more can be rolled by hand to this apparatus, and can be loaded on this apparatus or removed therefrom without a large consumption of energy.

One object of the invention is achieved due to the fact that program-controlled adjustments for speed variations and for torque variations of a drive member depend on a measurable winding diameter of the reel body. This takes place by means of a regulator. The actual value of the tensile force on the elongated object is measured by the torque on the drive member and is compared with an adjustable reference value. In case of a deviation, the actual value is returned to the reference value.

With this method according to the invention, winding or unwinding can be carried out extremely reliably and without excessive stresses on the object to be wound or unwound. In addition, a constant tensile force on this object is produced. This method is also especially suitable for the winding of cables, which have a very delicate construction.

The apparatus constructed according to the invention contributes to achieving uniform winding. For an optimum transmission of the torque from the driving member to the reel body, drive shafts are provided on which the reel body rests. Moreover, by means of an additional pressing roller on an upper side of the reel body, a pressing force directed towards the drive shafts is produced in order to achieve non-slip, operationally reliable guidance of the reel body.

Furthermore, according to the invention, a lifting device for loading or unloading the reel body on or off the apparatus is provided. This lifting apparatus advantageously comprises a tilting trough, by means of which the reel body can be raised onto the drive shafts or can be tilted away from the drive shafts.

BRIEF DESCRIPTION OF THE DRAWINGS

Embodiments of the invention as well as further advantages thereof are described in detail hereafter with reference to the drawings, in which.

DESCRIPTION OF THE PREFERRED EMBODIMENTS

Figure 1:
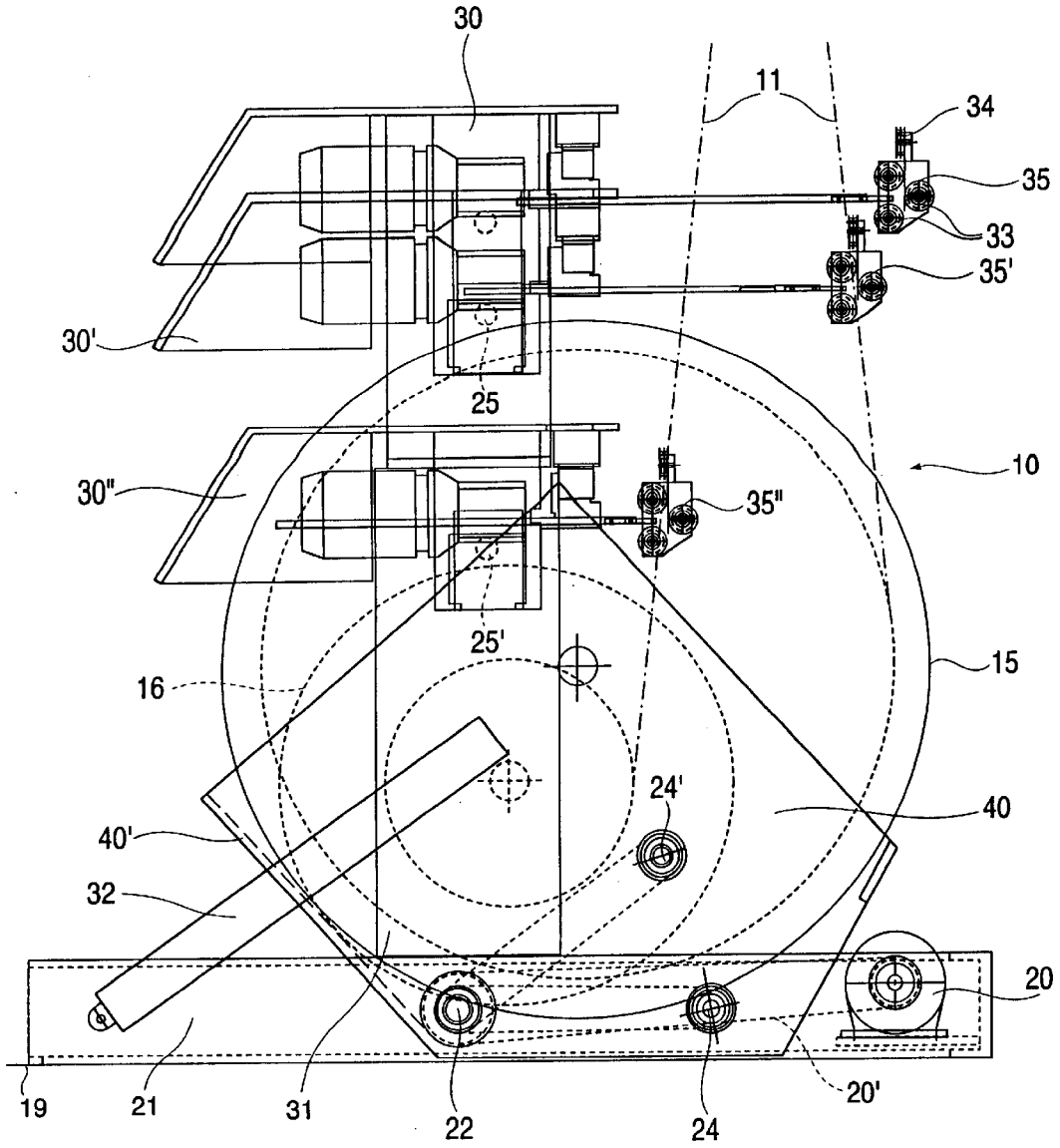
FIG. 1 is a diagrammatic side view of an apparatus according to the invention with an illustration of a laying frame at three different heights.

FIG. 1 shows an apparatus 10 for the controlled winding or unwinding of elongated objects 11 on or from a reel body 15 or a smaller reel body 16. The elongated objects 11 can be in particular cables, wires, strips, ropes, fabrics or the like. In this case, the apparatus 10 is designed so that standardized reel bodies, also called bobbins, with an outer diameter of 500 millimeters up to an outer diameter of one meter can be received.

According to the invention, the reel body 15 or 16 lies on at least two drive shafts 22, 24. At least one, and preferably both of the drive shafts 22, 24 are rotatably connected to the drive member 20, which can be an electric motor, by way of a toothed belt 20' or the like. For this purpose, a lifting device is provided, which is constructed so that the reel body 15, 16 can be rolled by hand onto the lifting device and lowered into a loading position. The lifting device mechanically lifts the reel body 15, 16 onto the drift shafts 22, 24 which can be driven by the drive member 20 or tilts the reel body away from drive shafts 22, 24.

The drive shafts 22, 24 have a diameter which is clearly smaller than that of the reel body 15, approximately in a ratio between 1:8 and 1:15. Due to this construction, when starting the rotation of the reel body, a very low torque is transmitted, which contributes to non-slip transmission of the rotation. When tilting a trough 40 for unloading the reel body 15 or 16, the rear drive shaft 24, which is mounted in the trough 40, is swung up into a position 24'. This causes the reel body to roll out of the device 10 and onto the base 19.

Furthermore, at least one pressing roller 25 is provided on an upper side of the reel body 15, 16, which produces a pressing force directed towards the drive shafts 22, 24, in order that the reel body does not fall off these drive shafts 22, 24 during winding. This pressing roller 25 is appropriately mounted to rotate on the under side of a laying frame 30 arranged to be vertically adjustable above the reel body 15, 16. In an operating position, the pressing roller 25 brings about a reaction force acting radially towards the center of the reel body 15, 16, which in its line of action is directed between the two drives shafts 22, 24.

The laying frame 30 is held on both sides by support legs 31 which can be adjusted in the vertical direction telescopically by means of a drive. The support legs 31 are in turn fastened to a base 21. The laying frame 30 can be vertically adjusted according to the diameter of the reel body 15, 16, from an upper end position into a position 30' or even lower into a position 30". A guide head 35 contained in the laying frame 30, at the time of winding, can be positioned as close as possible to the reel body 15 or 16, in order that the elongated object 11 is guided in an optimum manner.

In a method according to the invention for the controlled winding or unwinding of the elongated object 11 on the reel body 15, 16 or from the reel body 15, 16 a program-controlled adjustment is provided for adjusting for variations in speed as well as of torque of the drive member depending on the measurable winding diameter of the reel body 15, 16. The actual value of the tensile force is measured by torque on the drive member 20. The torque on the drive member 20 is compared with an adjustable reference value, and the actual value of the tensile force is maintained at the reference value by means of a torque regulator.

Due to the program-controlled adjustments of the variations in speed as well as the torque of the drive member 20, an increase in winding diameter is achieved. In particular, an adaption to the moment of resistance on the reel body 15, 16, which varies during the winding or unwinding operation, increases the winding diameter. As the winding diameter increases, more transmission power is required from the drive 20. Accordingly, the Speed at the drive 20 is reduced as the winding diameter becomes larger in order to maintain an approximately constant supply speed of the elongated object 11.

Figure 2:
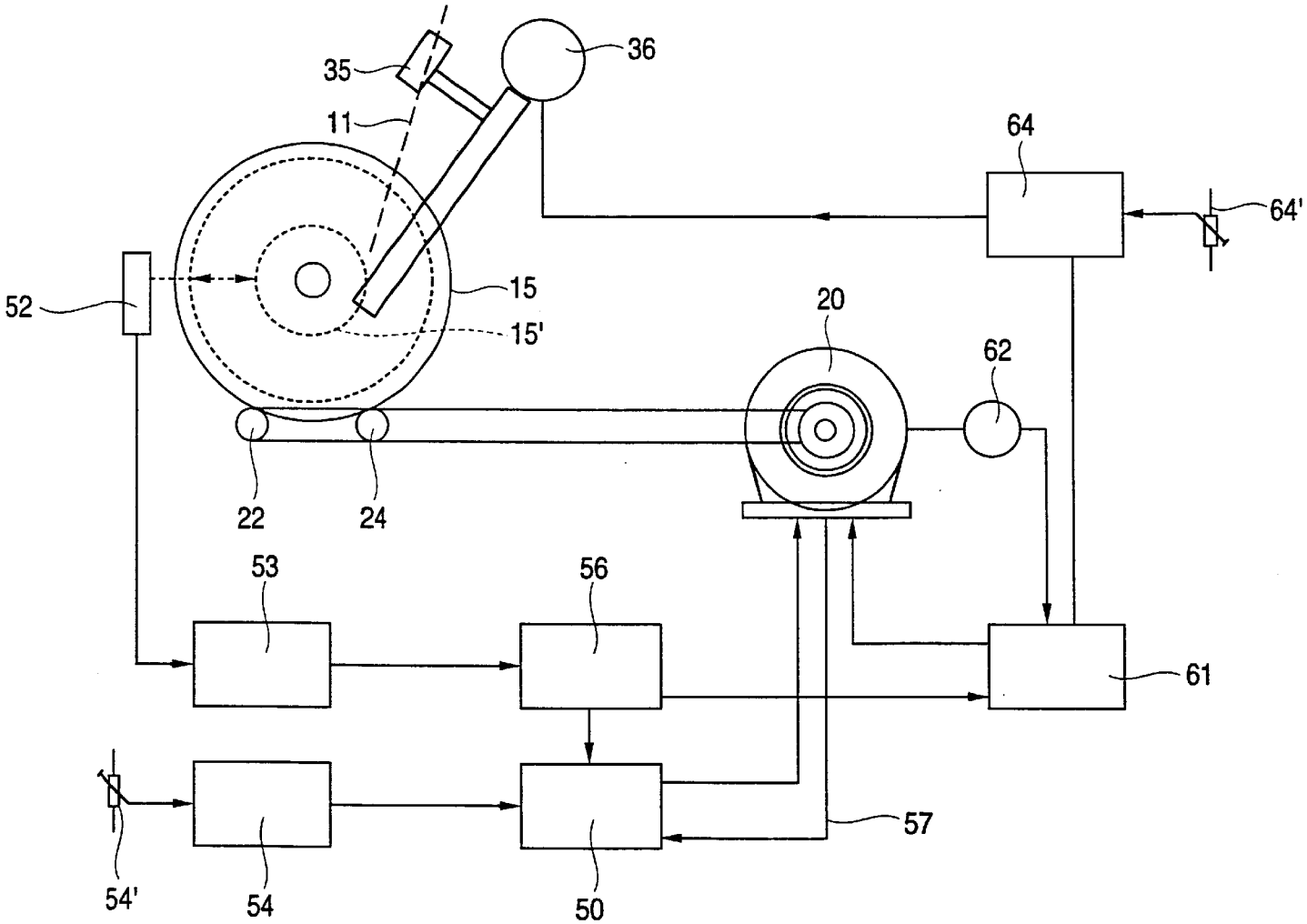
FIG. 2 is a block diagram of a method according to the invention for the controlled winding of an elongated object on a reel body.

According to FIG. 2, a reference value 54 for the tensile force on the elongated object 11 is adjusted via a potentiometer 54' or the like, and is sent to a regulator 50. At the same time, a current winding diameter 15' is measured by a sensor 52 and is received by a computer 56 through an encoder 53, or the like, which determines the program-controlled adjustment of the torque. This torque defined by the computer 56, together with the reference value 54, then serves as an actual reference quantity, by means which the regulator 50 controls the drive member 20. An actual value 57 of the measured torque is returned to the regulator 50, which consequently, in the case of a divergence from the reference value 54, undertakes adjustments according to the actual value. The adjustment of the torque is determined by the computer 56. Computer 56 compensates for the moment of resistance changing as the winding diameter becomes greater. By means of changing the reference value input 54, the program-controlled adjustment by the computer 56 is changed with a corresponding factor for the effective reference quantity.

At the same time as the regulation of the torque, a speed regulation of the drive member 20, and thus of the reel body 15, occurs. The speed in this case depends on a desired winding speed, which is ascertained from characteristic data which is specific to an installation, such as the nature of a wire, the diameter of the wire and/or other factors, such as for example the possible supply speed, which depends on a production machine supplying the wire or the like. Determining the speed depends on the winding diameter 15', which is measured by the sensor 52. This measurement signal is supplied to the computer 56 and is consequently used for program-controlled adjustment of the speed. This speed defined by the computer 56, in accordance with its software, is sent as a signal to a regulator 61, which controls the drive member 20 according to a speed reference value. The defined speed is in this case such that it decreases to achieve an approximately constant winding speed as the winding diameter increases. A tacho-alternator 62 then feeds back the actual value of the speed at the electric motor to a regulator 61, which in a conventional manner compares the actual value with the reference value, and if need be undertakes a correction of the reference value. The winding speed advantageously can be between 0 and 15 meters/minute, while the torque for the tensile force is adjustable as a rule between 30 and 150 Nm.

When unwinding, in connection with the regulation of the torque, a difference exists as compared to winding in so far that the drive member 20, which can be an electric motor, acts as a brake. Due to this, a desired tensile force on the unwinding, elongated object 11 is produced. Otherwise, this unwinding method can be used in a similar way as the winding method.

Furthermore, within the scope of the method according to the invention, an exact adjustment of the guide head 35 guiding the elongated object 11 takes place. In order to allow laying in rows, one beside the other without gaps of the object 11, for example wire, onto the reel body 15, guide head 35 is moved in a reciprocating motion parallel to the axis of rotation of the reel body 15 by a feed unit having a spindle shaft 38 driven by a layer motor 36. The pitch per rotation therefore corresponds approximately to the outer diameter of the object to be wound. A reference value for the pitch per revolution can be fixed by means of a potentiometer 64' or the like. A control member 64 receives a signal from the tach-alternator 62 and controls the laying motor 36 with a proportional quantity. The laying motor 36 controls a speed of the spindle shaft 38. Thus, a predetermined pitch of the guide head 35 adjusts according to the diameter of the object 11 to be wound.

In addition, the guide head 35 is mounted to move freely in the horizontal direction in the laying frame 30, perpendicular to the axis of rotation of the reel body 15. Due to this, the elongated object 11 is guided in the guide head 35 by several rollers 33, 34 and is supplied to the reel body at an approximately constant angle. The rollers 33, 34 appropriately comprise annular grooves in which the wire or the like is guided.

The lifting device is advantageously formed from the tilting trough 40, which has an opening for receiving the reel body 15, 16 into the loading position. The tilting trough 40 is arranged to tilt about a tilting axis extending approximately coaxially with the front drive roller 22. Provided for the tilting of the trough 40 is a tilting cylinder 32 or the like shown in FIG. 1, which at one side is mounted to pivot on the base 21 and at the other side is mounted laterally on the tilting trough 40. This tilting trough 40 in this case has a front wall 40, which rests approximately on the floor 19 supporting the device 10, when the trough 40 is tilted down, so that at the time of loading, the reel body can be rolled into the trough, as illustrated in FIG. 5.

Figure 3:
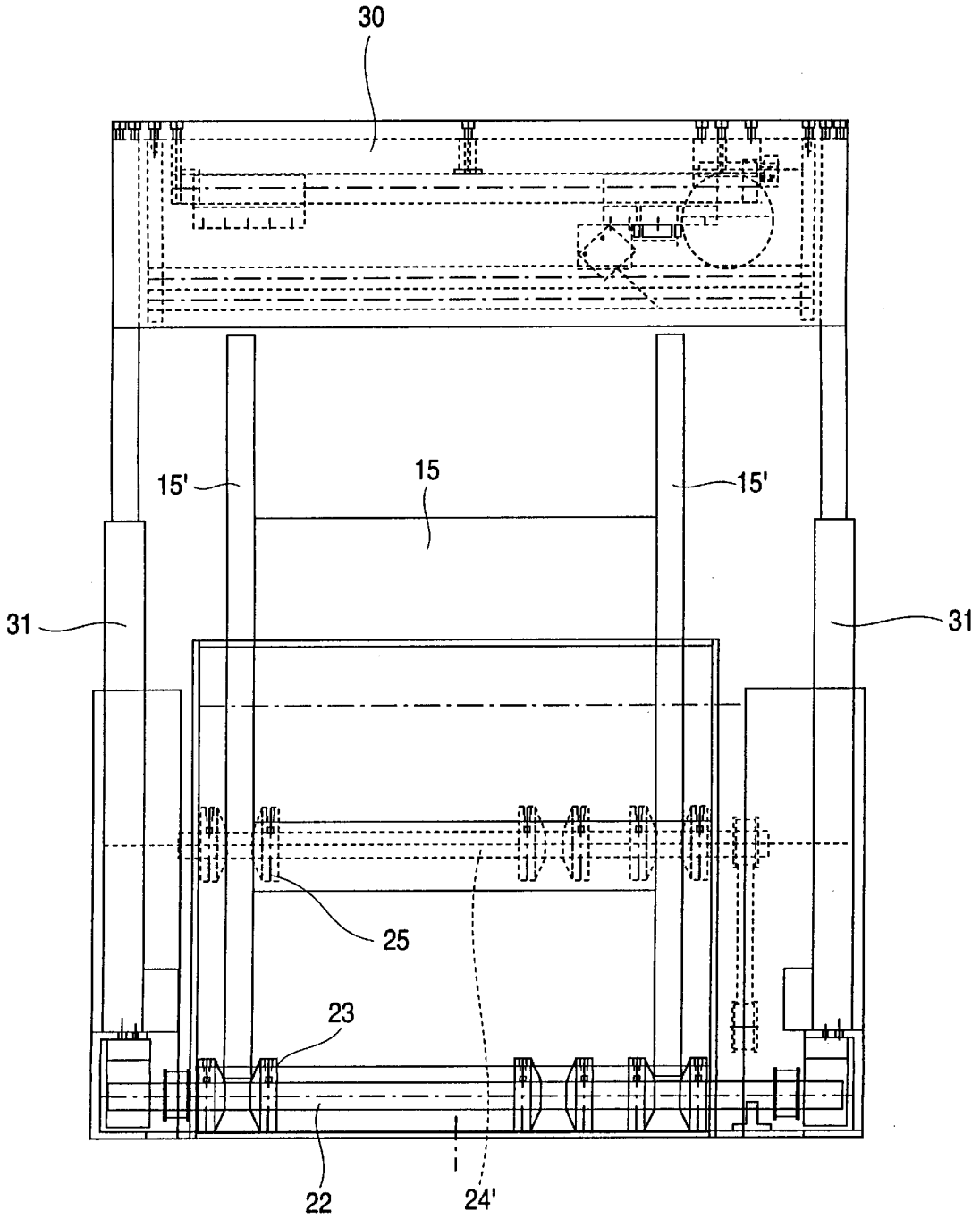
FIG. 3 is a diagrammatic front view of the apparatus according to FIG. 1.

According to FIG. 3, the reel body 15 comprises on both sides respectively disc-shaped side walls 15', which are centered by corresponding stop rings 23, 25 on the drive shafts 22, 24. These stop rings 23, 25, which are adjustable on the drive shafts 22, 24, prevent a displacement of the reel body 15 in the axial direction of these drive shafts. Furthermore, the drive shaft 24 is illustrated in the unloading position 24'.

Figure 4:
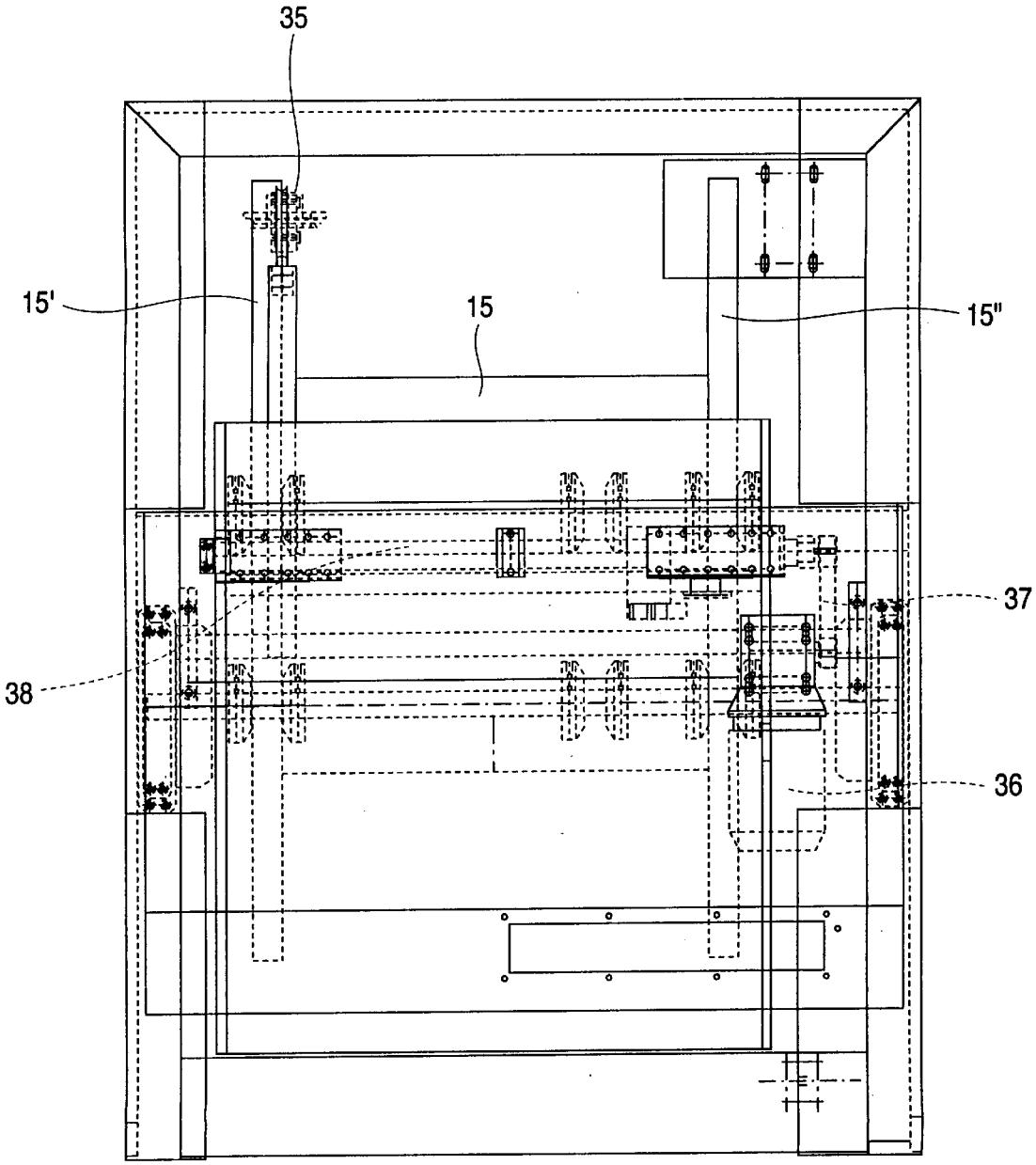
FIG. 4 is a diagrammatic plan view of the apparatus.

FIG. 4 is a plan view of the apparatus 10, in which a feed unit of the guide head 35 is visible. The spindle shaft 38 is driven by the laying motor 36 by way of a toothed belt 37 or the like. Rotating the spindle shaft 38 causes a linear feed movement of the guide head 35 parallel to the axis of rotation of the reel body 15.

Figure 5:
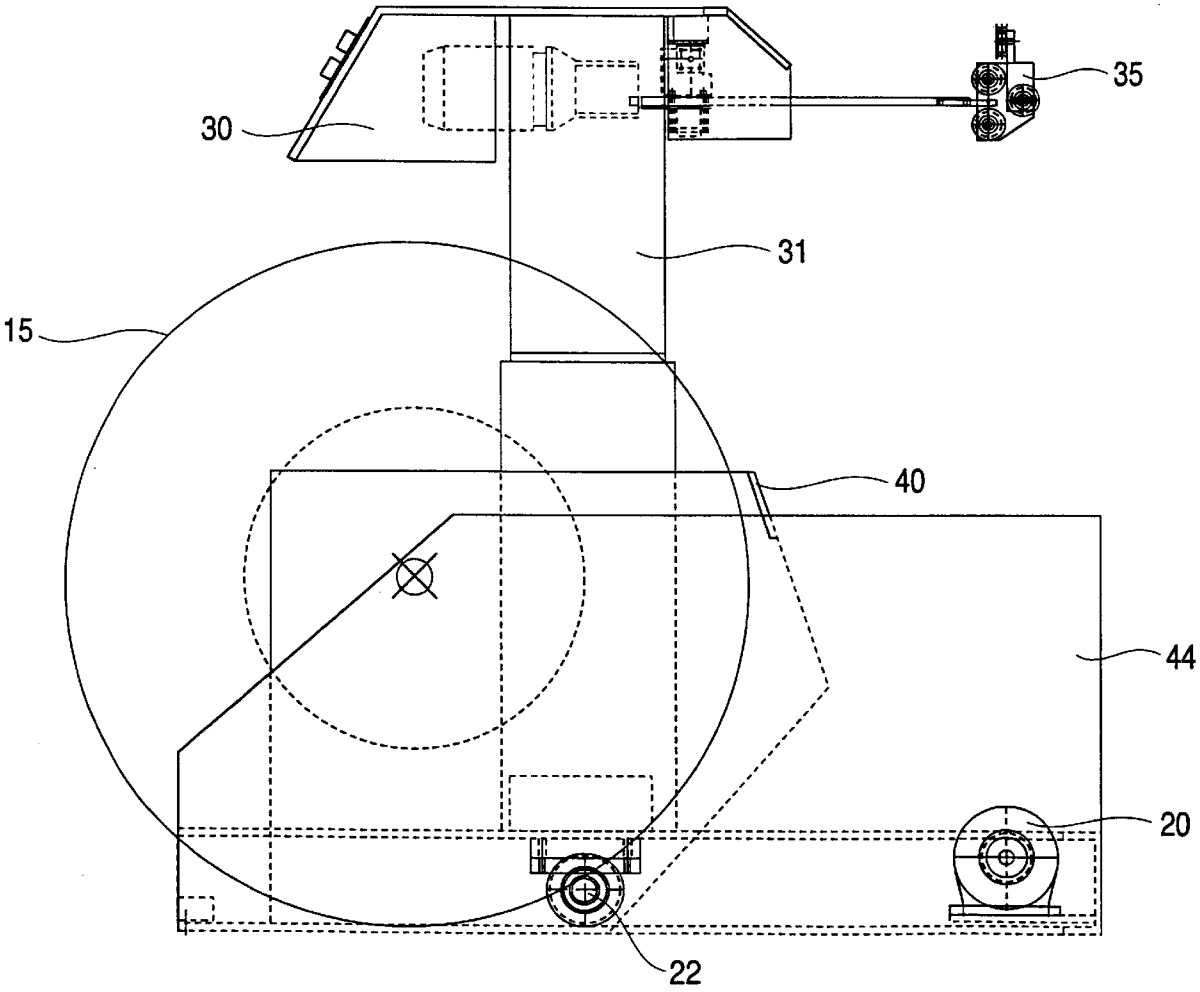
FIG. 5 is a diagrammatic side view of the apparatus in the loading position.

FIG. 5 shows the tilting trough 40 in the loading position, in which the reel body 15 can either be tilted onto the drive shafts 22, 24 by tilting the tilting trough 40 upwards, or it can be rolled out of the tilting trough 40. In this loading position, the laying frame 30 is advantageously moved into the upper end position. Furthermore, a lateral cover 44 of the apparatus 10 is shown by dotted shading.

It should also be noted that in diagrammatic drawings, invisible lines are illustrated partially by continuous lines.

What is claimed is:

1. An apparatus for controlled winding and unwinding of an elongated object around a reel body, comprising:

a drive member;

a first drive shaft rotatably coupled to said drive member;

a second drive shaft mounted in relation to said first drive shaft so as to be capable to support the reel body;

a lifting device including a tilting trough having a front wall and a back wall attached to said front wall so as to form an opening for receiving the reel body and a tilting cylinder coupled to said tilting trough, said tilting trough being pivotally mounted such that said tilting trough can be tilted by said tilting cylinder in order to load and unload the reel body from said first and second drive shafts.

2. The apparatus according to claim 1, wherein said second drive shaft is rotatably coupled to said drive member.

3. The apparatus according to claim 1, further comprising a pressing roller mounted in relation to said first and second drive shafts so as to be capable to produce a pressing force on the reel body.

4. The apparatus according to claim 1, wherein said first drive shaft has an outer diameter eight to fifteen times smaller than a diameter of the reel body.

5. The apparatus according to claim 1, wherein said second drive shaft has an outer diameter eight to fifteen times smaller than a diameter of the reel body.

6. The apparatus according to claim 1, further comprising a laying frame positioned so as to be vertically adjustable with respect to said first and second drive shafts.

7. The apparatus according to claim 6, further comprising a guide head coupled to a feed unit which is supported by said laying frame such that said feed unit imparts a reciprocating movement parallel to an axis of rotation of said first drive shaft on said guide head.

8. The apparatus according to claim 7, further comprising a control member connected to said feed unit which regulates said guide head's reciprocating movement according to an adjustable pitch reference value and an outer diameter of the reel body.

9. The apparatus according to claim 7, further comprising a pressing roller mounted on said laying frame.

10. The apparatus according to claim 6, further comprising a pressing roller mounted on said laying frame.

11. The apparatus according to claim 1, further comprising a torque regulator connected to said drive member which regulates a torque delivered by said drive member according to an adjustable torque reference value and an outer diameter of the reel body.

12. The apparatus according to claim 1, further comprising a speed regulator connected to said drive member which regulates a speed of said drive member according to an adjustable speed reference value and an outer diameter of the reel body.

13. The apparatus according to claim 1, wherein said tilting trough tilts about a tilting axis which extends approximately coaxial with respect to said first drive shaft.

14. The apparatus according to claim 1, wherein said tilting trough tilts about a tilting axis which extends approximately coaxial with respect to said second drive shaft.

* * * * *